US005566612A

United States Patent [19]

Satoh

[11] Patent Number: 5,566,612

[45] Date of Patent: Oct. 22, 1996

[54] MIMEOGRAPHIC PRINTING MACHINE

[75] Inventor: Yuji Satoh, Tokyo, Japan

[73] Assignee: Riso Kagaku Corporation, Tokyo, Japan

[21] Appl. No.: 507,842

[22] Filed: Jul. 27, 1995

[30] Foreign Application Priority Data

Aug. 8, 1994 [JP] Japan ..... 6-185791

[51] Int. Cl.[6] ..... B41L 13/14

[52] U.S. Cl. ..... 101/119; 101/116

[58] Field of Search ..... 101/119, 118, 101/116, 114, 120, 126, 127, 127.1, 128, 128.1, 113, 2, 70; 400/717, 718

[56] References Cited

U.S. PATENT DOCUMENTS

| | | | |
|---|---|---|---|
| 1,497,149 | 6/1924 | Lehmann | 101/90 |
| 3,948,169 | 4/1976 | Cole | 101/128 |
| 5,035,175 | 7/1991 | Takita et al. | 101/118 |
| 5,323,706 | 6/1994 | Sugawara | 101/114 |
| 5,443,556 | 8/1995 | Hasegawa et al. | 101/128.1 |

FOREIGN PATENT DOCUMENTS

| | | | |
|---|---|---|---|
| 0110204 | 6/1984 | European Pat. Off. | 101/119 |
| 0179986 | 5/1986 | European Pat. Off. . | |
| 4-69073 | 11/1992 | Japan . | |

*Primary Examiner*—Edgar S. Burr
*Assistant Examiner*—Anthony H. Nguyen
*Attorney, Agent, or Firm*—Kanesaka & Takeuchi

[57] ABSTRACT

Disclosed is a mimeographic printing machine formed of a cylindrical printing drum which has an ink-previous area for passing ink from an inner peripheral surface to an outer peripheral surface, and is driven to rotate on the center axis of itself with a stencil paper wrapped around the outer peripheral surface; an ink supply device provided within the printing drum, for supplying the ink to the inner peripheral surface; a clamping device provided on the outer peripheral surface of the printing drum, for clamping on the printing drum a leading edge of the stencil paper wrapped around the outer peripheral surface; and a stencil paper holding device provided on the outer peripheral surface of the printing drum, for holding on the printing drum the leading edge of the stencil paper when the clamping device has released the stencil paper.

7 Claims, 7 Drawing Sheets

MIMEOGRAPHIC PRINTING MACHINE

BACKGROUND OF THE INVENTION

The present invention relates to a mimeographic printing machine having a clamping means for clamping on a printing drum the leading edge of a mimeograph stencil paper wrapped around the outer peripheral surface of the printing drum, and more particularly to a mimeographic printing machine so designed that the stencil paper will be prevented from rising at the leading edge when released from the clamping means, and will be smoothly discharged thereafter.

In a general mimeographic printing machine of prior art having a stencil paper preparing device, the leading edge of a mimeograph stencil paper wrapped around the outer peripheral surface of a printing drum is clamped by an openable-closable clamp plate. The printing paper is carried into the apparatus in synchronization with the rotation of the printing drum, and printing is performed by transferring the ink to this paper through the perforating section of the stencil paper wrapped around the printing drum.

When a stencil paper is to be perforated by the use of a new original copy, the existing stencil paper on the outer peripheral surface of the printing drum is stripped off and this stripped stencil paper is ejected to a used stencil paper holding section, that is, stencil paper discharge operation is effected. This stencil paper discharge operation is carried out for example as follows. First, the clamp plate is opened to release the stencil paper. In this state, the printing drum is rotated to insert a stencil paper discharge craw into a stencil paper discharge position between the printing drum and the leading edge of the stencil paper raised from the outer peripheral surface of the printing drum. Thus the leading edge of the stencil paper is led between rollers, by which the stencil paper is stripped from the printing drum with the rotation of the rollers and is carried to be ejected out to the used stencil paper holding section.

In the prior art mimeographic printing machine in general use described above, the stencil paper wrapped around the printing drum is clamped at the leading edge having an edge nearly parallel with the direction of an axis of the printing drum by means of an openable-closable clamp plate which rotates on the center of a shaft parallel with the direction of the axis of the printing drum. A larger part of the stencil paper located on the delay side in the direction of a printing drum rotation is held on the outer peripheral surface of a the printing drum with the adhesion of the ink supplied through the opening provided in the printing drum.

Therefore, when the clamp plate is opened to release the leading edge of the stencil paper, the area ranging from the leading edge of the stencil paper to the opening area of the printing drum becomes free. This area of the stencil paper that has become free is curled (upward curl) in the direction in which the stencil paper goes away from the outer peripheral surface of the printing drum or is curled (downward curl) inwardly to approach the outer peripheral surface of the printing drum.

The curling direction of the free leading edge of the stencil paper depends upon several conditions explained below. First, the stencil paper is generally supplied in the form of roll, and the rolled condition of the stencil paper determines the curling direction. The stencil paper is a laminate of a thermoplastic synthetic resin film and a porous substrate. When this stencil paper is rolled, the curling direction is determined by whether a portion appearing on the outermost surface is the thermoplastic synthetic resin film or the porous substrate. Temperature and humidity changes can be the factors that determine the curling direction.

In the case of a large degree of upward curling, it becomes difficult to properly lead the leading edge of the stencil paper into the rollers, resulting in erratic discharge of used stencils. Also when the printing drum is rotated to discharge the used stencil paper with the leading edge curled upward, as the distance from the leading edge of the stencil paper to the opening area of the printing drum is longer and the printing drum rotation is faster, the leading edge of the stencil paper is raised larger by an air pressure, making it difficult to lead the leading edge of the stencil paper into a pair of rollers working as a used stencil paper conveying means.

Furthermore, when the leading edge of the stencil paper is largely curled downward, there exists no clearance between the printing drum and the leading edge, and therefore it is difficult to lead the leading edge by the stencil paper discharge craw into the rollers, thus causing a discharged stencil paper jam to occur. In order to solve the problem of the discharged stencil paper jam resulting from the presence of the downward curled leading edge or electrostatic adhesion of the stencil paper on the printing drum, there has been disclosed in Japanese Patent Publication No. Hei 4-69073 a raising member for raising the leading edge of the stencil paper when the clamp plate is opened. This raising member is designed to operate in connection with the opening and closing of the clamp plate; when the clamp plate is opened, the raising member rises in the vicinity of the leading edge to raise the leading edge off the outer peripheral surface of the printing drum, thereby providing a clearance between the outer peripheral surface of the printing drum and the raised leading edge of the stencil paper to thus prevent the adhesion of the stencil paper to the printing drum.

However, since the leading edge of the stencil paper raised by the raising member slips down to the delay side in the direction of the printing drum rotation, it becomes difficult to provide a clearance wide enough to insert the stencil paper discharge craw between the printing drum and the leading edge of the stencil paper. Consequently, the raising member alone is not fully effective to prevent the discharged stencil paper jam.

SUMMARY OF THE INVENTION

In view of the above-described various problems, it is an object of the present invention to provide a mimeographic printing machine which is capable of preventing a discharged stencil paper jam resulting from the curling of the leading edge of the stencil paper which occurs when the clamping means is opened, so that the leading edge of the stencil paper can be led properly to a stencil paper discharge section.

The mimeographic printing machine according to the first aspect of the present invention comprises a cylindrical printing drum which has an ink-pervious area through which the ink passes from the inner peripheral surface out to the outer peripheral surface, is wrapped around the outer peripheral surface with a stencil paper, and is driven to rotate on the center axis thereof; an ink supply means provided in the printing drum, for supplying the ink to the inner peripheral surface; a clamping means provided on the outer peripheral surface of the printing drum, for clamping the leading edge of the stencil paper to the printing drum; and a stencil paper holding means provided on the outer peripheral surface of the printing drum, for holding the stencil paper to the printing drum in the vicinity of the leading edge of the stencil paper when the clamping means is released to unclamp the stencil paper.

The mimeographic printing machine according to the second aspect of the present invention comprises a cylindrical printing drum which has an ink-pervious area through which the ink passes from the inner peripheral surface out to the outer peripheral surface, is wrapped around the outer peripheral surface with a stencil paper, and is driven to rotate on the center axis thereof; an ink supply means provided in the printing drum, for supplying the ink to the inner peripheral surface; a clamping means provided on the outer peripheral surface of the printing drum, for clamping the leading edge of the stencil paper to the printing drum; and a stencil paper holding means provided on the outer peripheral surface of the printing drum, for holding the stencil paper to the printing drum in the vicinity of the leading edge of the stencil paper when the clamping means is released to unclamp the stencil paper, and for releasing the leading edge of the stencil paper when the clamping means is set to clamp the stencil paper.

In the mimeographic printing machine according to the third aspect of the present invention, the clamping means stated in the mimeographic printing machine of the second aspect has a shaft mounted on the outer peripheral surface of the printing drum in parallel with the center axis of the printing drum, and a clamp plate which rotates on the center of the shaft.

The mimeographic printing machine according to the fourth aspect of the present invention is based on the mimeographic printing machine of the third aspect and comprises a driven member which is mounted on the outer peripheral surface of the printing drum so as to be movable between the inside and the outside relative to the range of rotation of the clamp plate, and moves out of the range of rotation of the clamp plate, in contact with the end part of the clamp plate which is rotating; a driving member for driving the driven member to set the clamp plate within the range of rotation; and a retaining member provided on the driven member for retaining on the printing drum side the vicinity of the leading edge of the stencil paper when the driven member is set within the range of rotation of the clamp plate.

The mimeographic printing machine according to the fifth aspect of the present invention is based on the mimeographic printing machine of the fourth aspect and has a raising member which is provided on the outer peripheral surface of the printing drum and rises outward of the outer peripheral surface of the printing drum to raise the stencil paper off the outer surface of the printing drum when the stencil paper is released from the clamping means.

In the mimeographic printing machine according to the sixth aspect of the present invention, the clamping means in the mimeographic printing machine of the fifth aspect has a stencil paper support surface provided on the outer peripheral surface of the printing drum, for holding the leading edge of the stencil paper between the stencil support surface and the clamp plate.

According to the mimeographic printing machine of the seventh aspect of the present invention, the raising member in the mimeographic printing machine of the sixth aspect is an elastic thin piece secured at one end by the clamp plate and at the other end on the outer peripheral surface of the printing drum; a portion from the one end to the other end is at least partly disposed above at least a part of the stencil paper support surface; and the raising member rises off the stencil paper support surface when the clamp plate is released from the stencil paper support surface.

According to the constitution of the present invention, with the opening of the clamping means clamping the leading edge of the stencil paper, the leading edge of the stencil paper that has been clamped by the clamping means on the outer peripheral surface of the printing drum becomes free. When the leading edge is curled in a direction in which it moves away from the outer peripheral surface of the printing drum, the stencil paper retaining member keeps the leading edge of the stencil paper in an appropriately raised state, thereby allowing the movement of the leading edge of the stencil paper to the stencil paper conveying means without being affected by the rotational speed of the printing drum at the time of stencil paper discharge. Furthermore, in case the leading edge of the stencil paper raised by the raising member curls in a direction in which it approaches the outer peripheral surface of the printing drum, the stencil paper can be prevented from slipping down to the delay side of printing drum rotation if caused by the rise of the raising member because the vicinity of the leading edge is held on the outer peripheral surface of the printing drum by means of the stencil paper retaining member. Therefore, there is properly formed a clearance between the outer peripheral surface of the printing drum and the stencil paper into which the stencil paper discharge craw can be inserted, thus properly leading the leading edge of the stencil paper to the conveying means.

The above and other objects, features and advantages of the present invention will become more apparent from the following detailed description with reference to the accompanying drawings.

DETAILED DESCRIPTION OF THE PREFERRED EMBODIMENT

One embodiment of a mimeographic printing machine according to the present invention will be explained in detail with reference to FIGS. 1 to 7.

Figure 1:
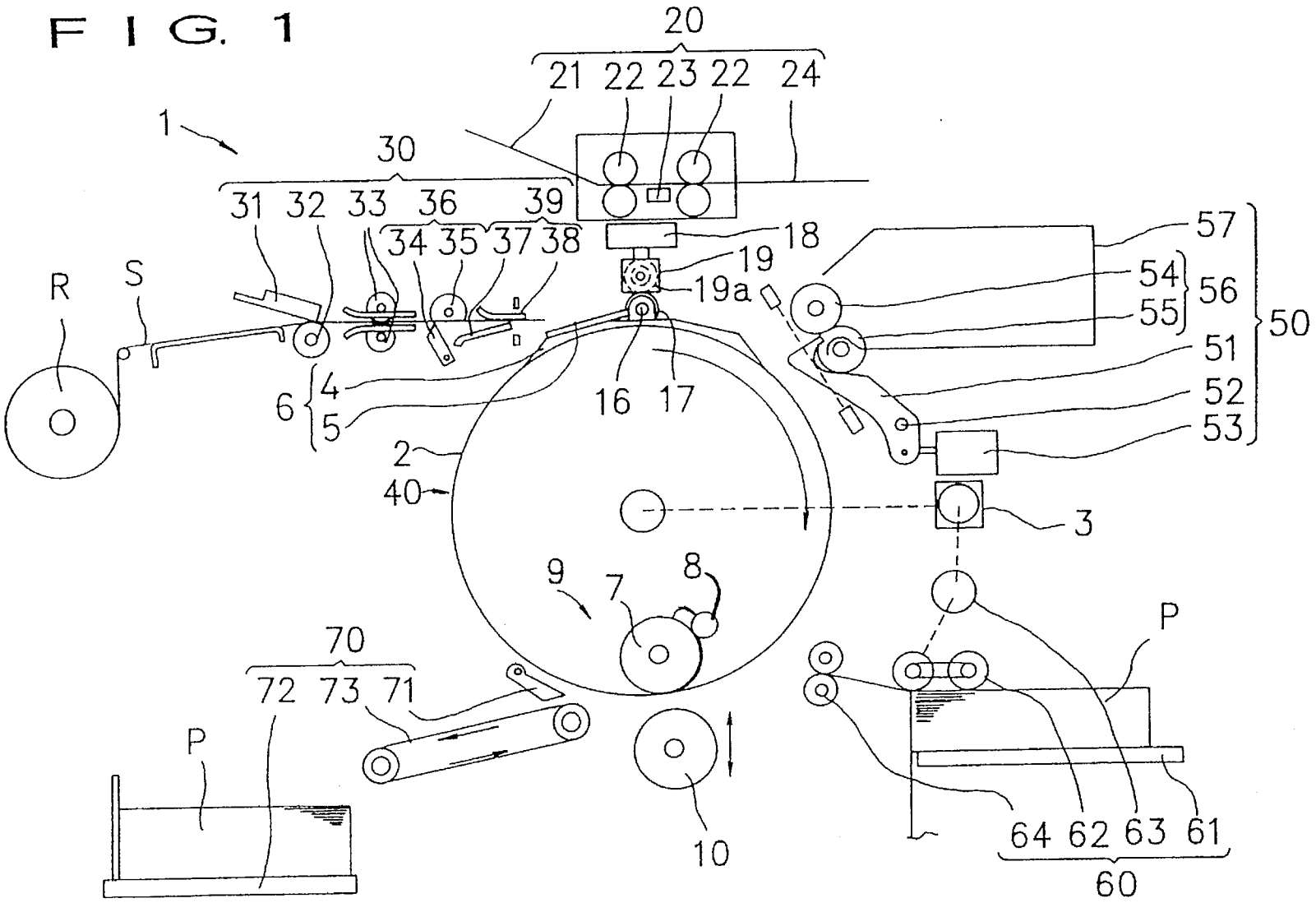
FIG. 1 is a schematic sectional view showing the general constitution of one embodiment of a mimeographic printing machine.

FIG. 1 shows one embodiment of the mimeographic printing machine of the present invention. The mimeographic printing machine 1 has an original image reading section 20, a thermal stencil paper preparing section 30, a mimeograph mechanism section 40, a stencil paper discharge section 50, a paper feeding section 60, and a paper delivery section 70.

As shown in FIG. 1, the original image reading section 20 has an original setting table 21, a pair of original feed rollers 22, an image sensor 23 of for example a contact type which optically reads an original image and converts it to an electric signal, and an original discharge tray 24 for stacking the original after reading the image.

As shown in FIG. 1, the stencil paper making section 30 has a thermal head 31 provided with a plurality of heating elements arranged perpendicularly to the paper surface in the drawing, and a platen roller 32 provided oppositely to the thermal head 31, so that the mimeograph stencil paper S can be thermally perforated and conveyed to the printing drum 2 side described later. Adjacently to the thermal head 31 and the platen roller 32 there are mounted a pair of upper and lower original feed rollers 33, a stencil paper cutter 36 consisting of a pair of upper and lower blades, that is, a fixed blade 34 and a movable blade 35, for cutting a series of perforated stencil S to each stencil paper, and a stencil paper guide plate 39 consisting of a lower stencil paper guide plate 37 and an upper stencil paper guide plate 38 for guiding the prepared stencil paper S to the clamping section of the printing drum 2 described later.

As shown in FIG. 1, the mimeograph mechanism section 40 has the cylindrical printing drum 2 rotatable on the center axis thereof and having an ink pervious area. The printing drum 2 is driven by a main motor 3 to rotate in a clockwise direction in FIG. 1. On the outer peripheral surface of the ink-impervious area of the printing drum 2 is provided a stencil paper clamp section as a clamping means which comprises a stage section 4 and a clamp plate 5 for clamping one end of the stencil paper in cooperation with the stage section 4. The clamp plate 5 is designed to turn through about 180 degrees on the stage section 4, to thereby selectively clamp or unclamp the leading edge of the stencil paper S.

In the interior of the printing drum 2 is provided an ink supply mechanism section 9 including a squeegee roller 7 and a doctor rod 8, thereby enabling to supply the ink to the inner peripheral surface of the printing drum 2. Beneath the printing drum 2 an impression roller 10 is vertically movably mounted. The impression roller 10 presses, against the outer peripheral surface of the printing drum 2, the paper P that has been fed in between the printing drum 2 and the impression roller 10 in synchronization with the rotation of the printing drum 2, thus transferring to the paper P the ink supplied through the ink-pervious area of the printing drum 2 and the opening area of the stencil paper S.

As shown in FIG. 1, the stencil paper discharge section 50 has a stencil paper discharge craw 51. The stencil paper discharge craw 51 is pivotally supported on a shaft 52, and with its base end portion a solenoid 53 for driving the stencil paper discharge craw is interconnected. When the solenoid 53 for driving the stencil paper discharge craw is driven, the stencil paper discharge craw 51 is rotated within the range of specific angle on the center of the shaft 52. That is, the stencil paper discharge craw 51 is driven so that the leading edge of the stencil paper discharge craw 51 will move between the stencil paper S stripping position near the surface of the printing drum 2 and the waiting position apart by a specific distance from the printing drum 2. The stencil paper S that has been stripped from the printing drum 2 at the stripping position is guided in a direction (to the right in FIG. 1) in which the stencil paper S will come off the printing drum 2.

On the right of the stencil paper discharge craw 51 where the stencil paper S removed from the printing drum by the stencil paper discharge craw 51 is led, there is mounted a pair of stencil paper discharge rollers 56 including an upper roller 54 and a lower roller 55 for conveying the stencil paper S. Adjacently to the stencil paper discharge rollers 56, in the direction of conveyance, a discharged stencil paper storing box 57 is provided for discharging and storing used stencils S conveyed on the stencil paper discharge rollers 56.

The paper feed section 60 has a paper feed table 61 for loading the printing paper P which is driven to move up and down by means of a vertically moving mechanism not shown, a pickup roller 62 for taking out the paper P one by one from the paper feed table 61, a paper feed clutch 63 for intermittently transmitting the rotation of the main motor 3 to the pickup roller 62, and a pair of paper conveying rollers 64 for feeding the paper P at a specific timing between the printing drum 2 and the impression roller 10.

The paper delivery section 70 has a separating craw 71 for separating the printed paper P from the printing drum 2, and a belt conveyor-type delivery apparatus 73 for conveying the printed paper P stripped from the printing drum 2 by the separating craw 71, to the paper receiving tray 72.

Next, the construction of the printing drum 2 will be explained in further detail by referring to FIGS. 2 to 7. The printing drum 2 has a generally cylindrical shape with a pair of flanges 12 and 13 having rigidity being inserted in both open ends of a cylindrical peripheral wall 11; the peripheral wall 11 and both flanges 12 and 13 are fastened by fastening means such as screws. On the outer peripheral surface of the printing drum 2 which is kept in the cylindrical shape, one or two screens not shown are wrapped for evenly spreading the ink supplied from the inner peripheral surface of the printing drum 2.

The peripheral wall of the printing drum 2 has a rectangular opening section O which is an ink-pervious area having a number of openings, and an unopening section N which is an ink-impervious area. When the stencil paper S is wrapped around the printing drum 2, the perforating image section corresponds to the opening section O. Therefore, the ink supplied to the inner surface of the printing drum 2 during printing from the ink supply mechanism section provided inside the printing drum 2 passes out through the opening section O of the printing drum 2 and the perforated image section of the stencil paper S, and transferred to the paper P which is pressed against the outer peripheral surface of the printing drum 2.

Figure 2:
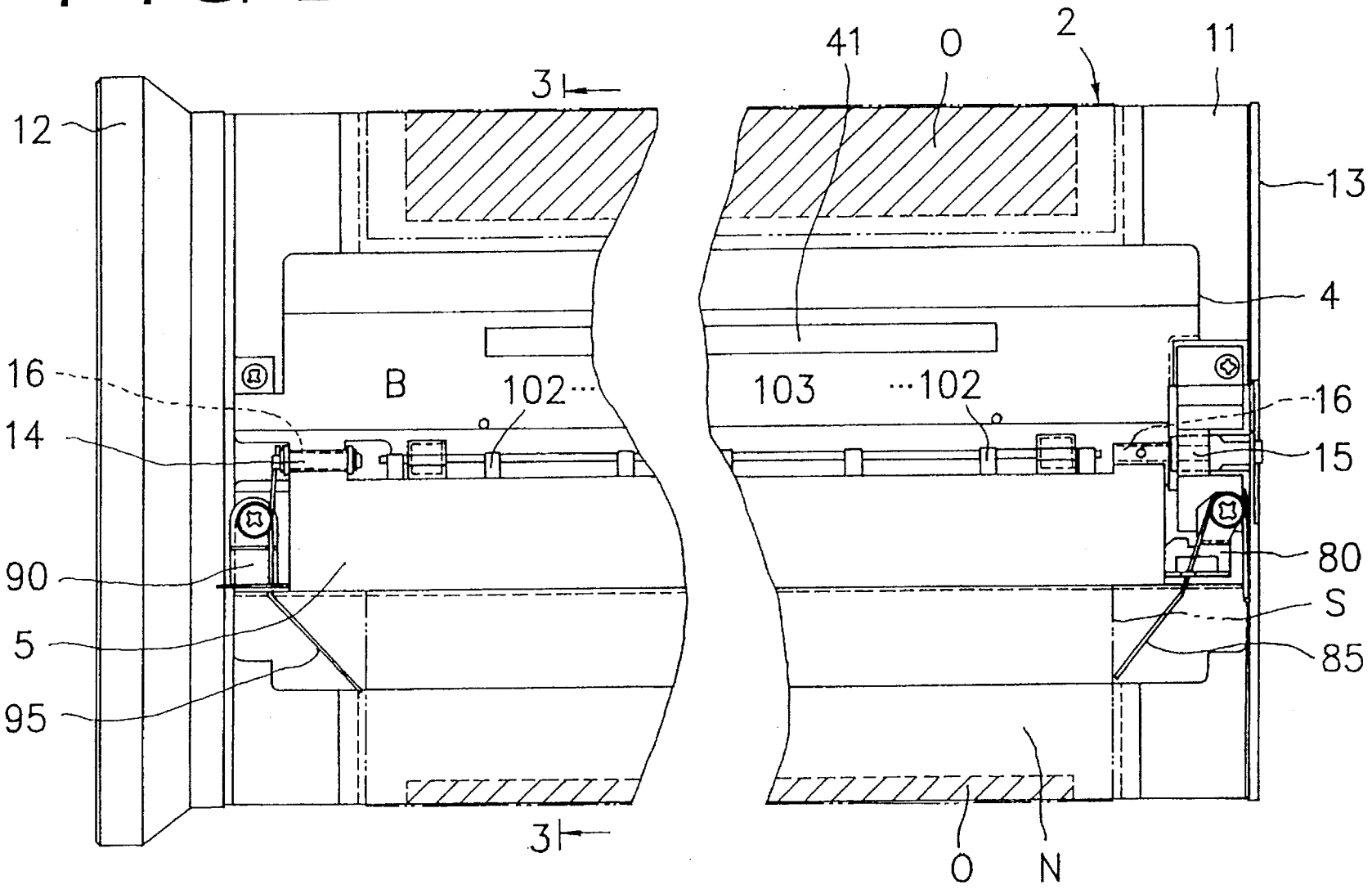
FIG. 2 is a plan view showing a printing drum of the mimeographic printing machine of one embodiment with a mimeograph stencil paper fastened with a clamp plate.
Figure 3:
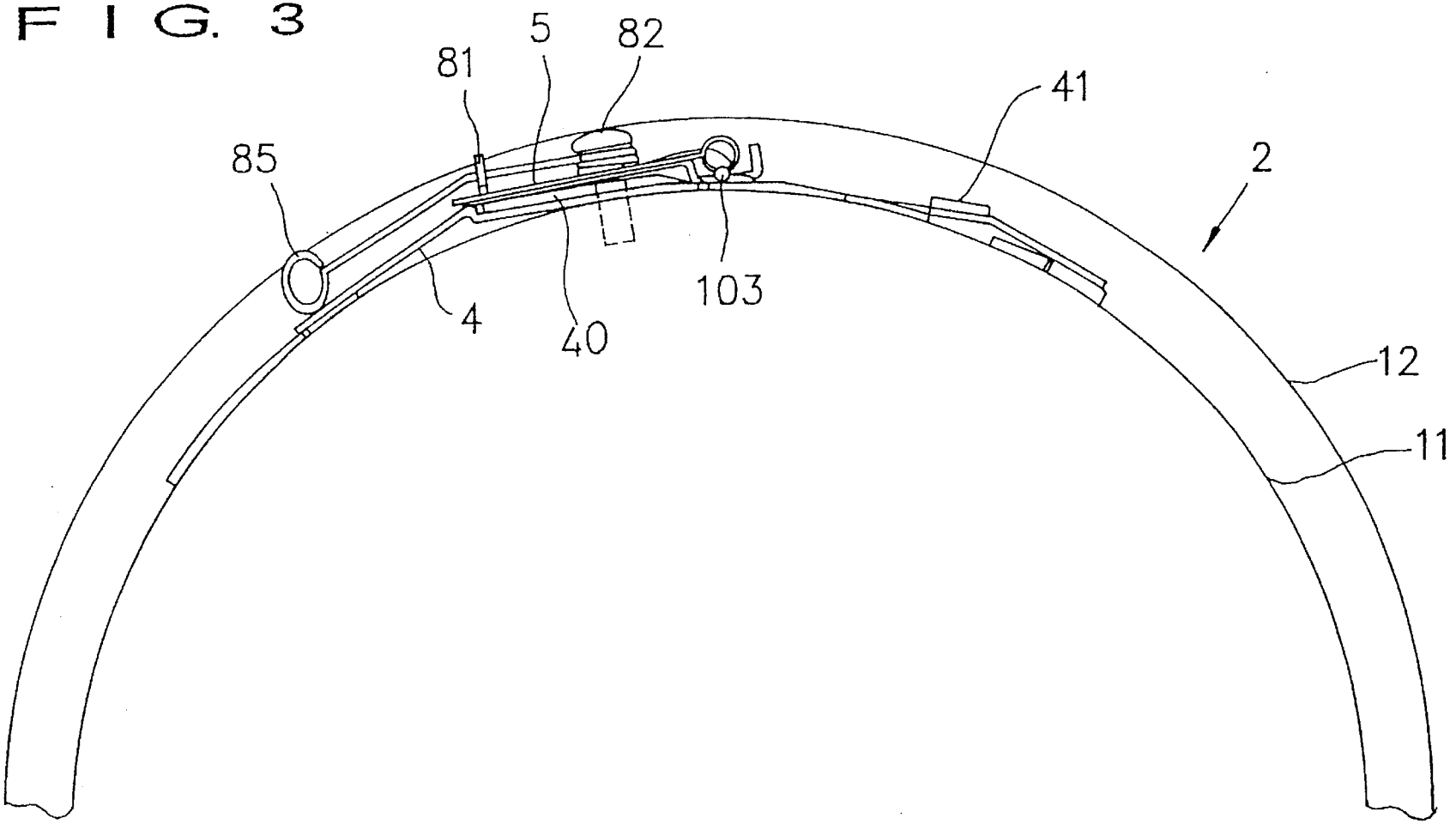
FIG. 3 is a sectional view taken along line 3—3 of FIG. 2.
Figure 4:
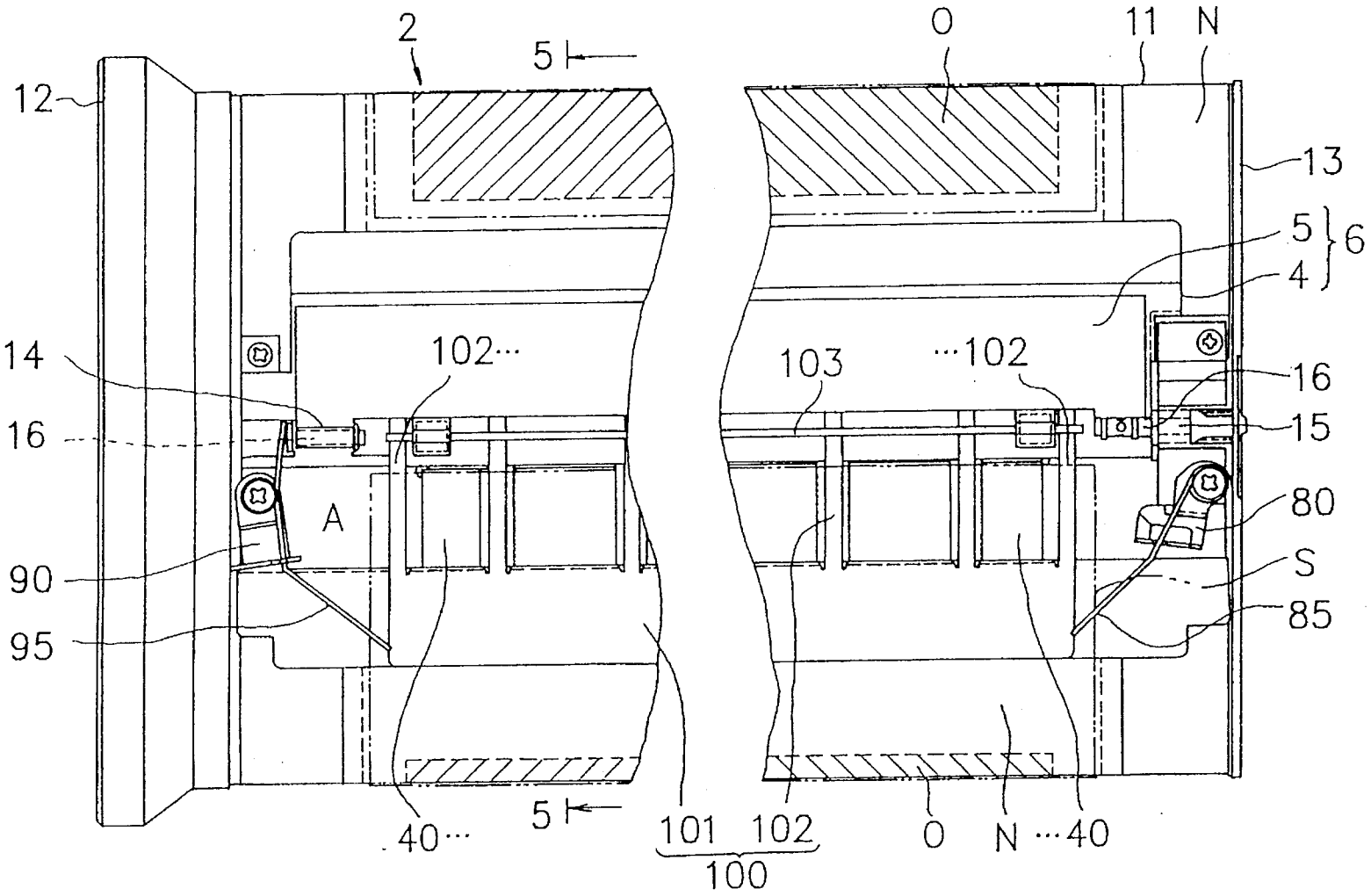
FIG. 4 is a plan view showing the printing drum of the mimeographic printing machine of one embodiment with the clamp plate opened to release the stencil.

On the outer peripheral surface corresponding to the unopening section N of the printing drum 2 a stage section 4 having two flat surfaces A and B arranged in the direction of rotation of the printing drum 2 is fastened by screws. The flat surfaces A serve as a stencil paper support surfaces which, together with the clamp plate 5, holds the leading edge of the stencil paper. As shown in FIGS. 2 to 4, two types of bearings 14 and 15 are juxtaposed along a direction parallel with the rotating shaft of the printing drum within an area between the flat surfaces A and B arranged in the direction of rotation of the printing drum 2. At both end parts of the clamp plate 5 are coaxially mounted a pair of pivot shafts 16, which are rotatably supported on the bearings 14 and 15, so that the clamp plate 5 is rotatable at the center of these pivot shafts 16.

Figure 6:
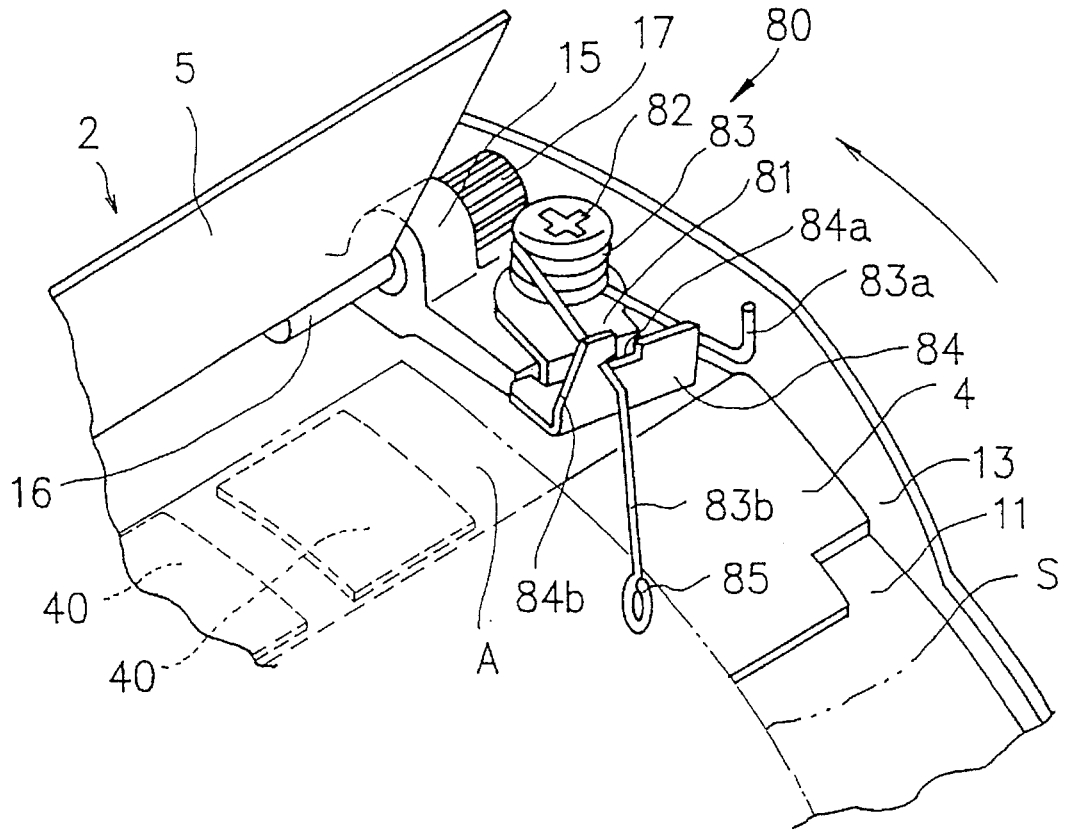
FIG. 6 is a perspective view showing a part of the printing drum of the mimeographic printing machine of one embodiment.

As shown in FIG. 6, a gear 17 is mounted on the outer end part of one pivot shaft 16 of the clamp plate 5. A clamp solenoid 18 shown in FIG. 1 is mounted on the body frame side which is a fastening member not shown. The clamp solenoid 18 can move up and down a clamp driving unit 19 having a driving gear **19*a* and a motor not shown which is a driving power source of the driving gear 19***a*, and can move the driving gear 19*a* into selective mesh with the gear 19 of the pivot shaft 16. When the driving gear 19*a* in mesh with the gear 17 is driven to rotate, the clamp plate 5 rotates through about 180 degrees on the stage section 4 of the printing drum 2. That is, the clamp plate 5 is driven to rotate on the center of the pivot shaft 16 between the clamp position (the position shown in FIGS. 1 to 3) in which the clamp plate 5, cooperating with the stage section 4, clamps the leading edge of the prepared stencil paper S that has been fed in from the stencil paper making section 3 and the non-clamp position to which the clamp plate 5 has been turned through about 180 degrees from this clamp position.

Figure 7:
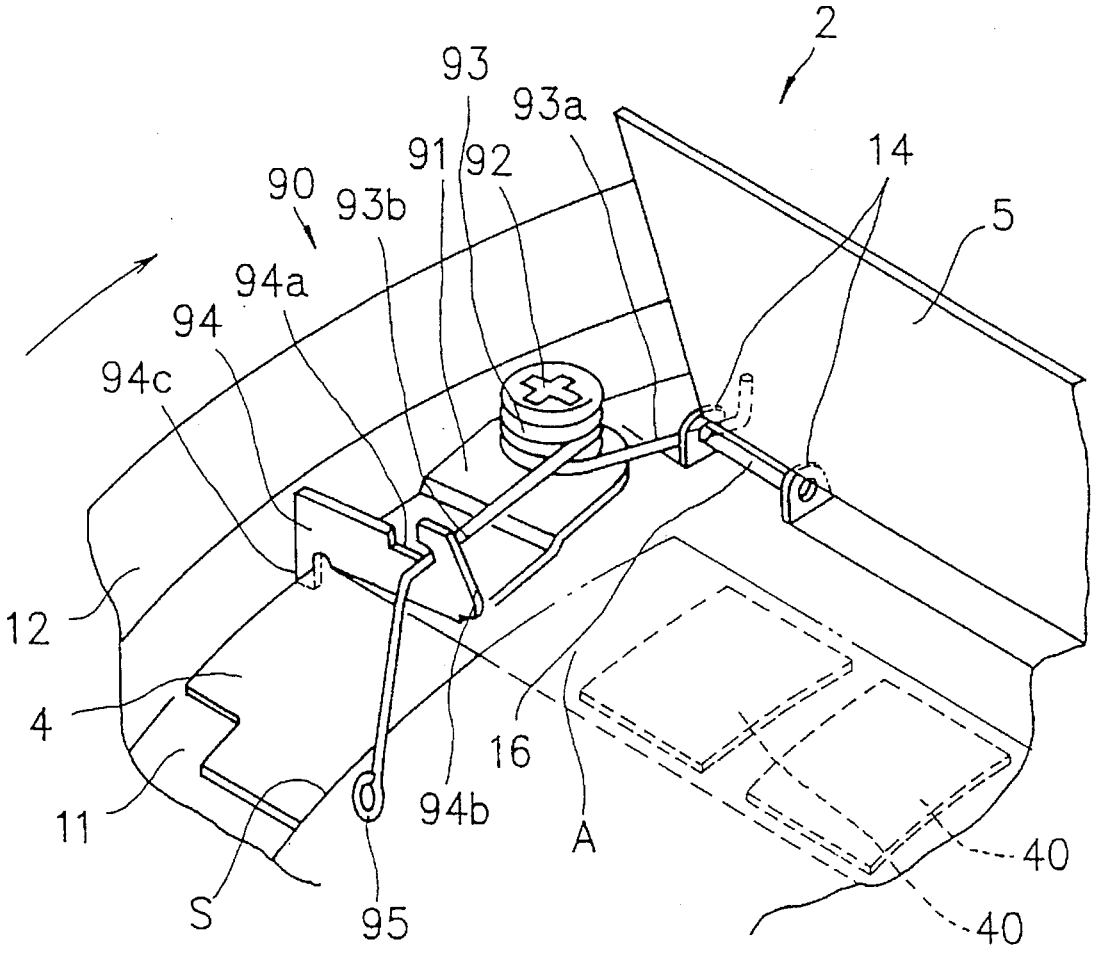
FIG. 7 is a perspective view showing a part of the printing drum of the mimeographic printing machine of one embodiment.

As shown in FIGS. 4, 6 and 7, a plurality of rectangular magnetic plates 40 are fixed in a row on the flat surface A of the stage section 4. The clamp plate 5 holding the leading edge of the stencil paper S, when attracted to the upper surface of the magnetic plate 40, is fixed in the clamp position and the leading edge of the stencil paper is clamped on the outer peripheral surface of the printing drum 2. Also as shown in FIG. 2, a belt-like magnetic plate 41 is provided along the longitudinal direction of the printing drum 2, on the flat surface B of the stage section 4. The clamp plate 5, when attracted to the upper surface of this magnetic plate 41, is fixed in the unclamp position where the stencil paper S is not clamped.

Figure 5:
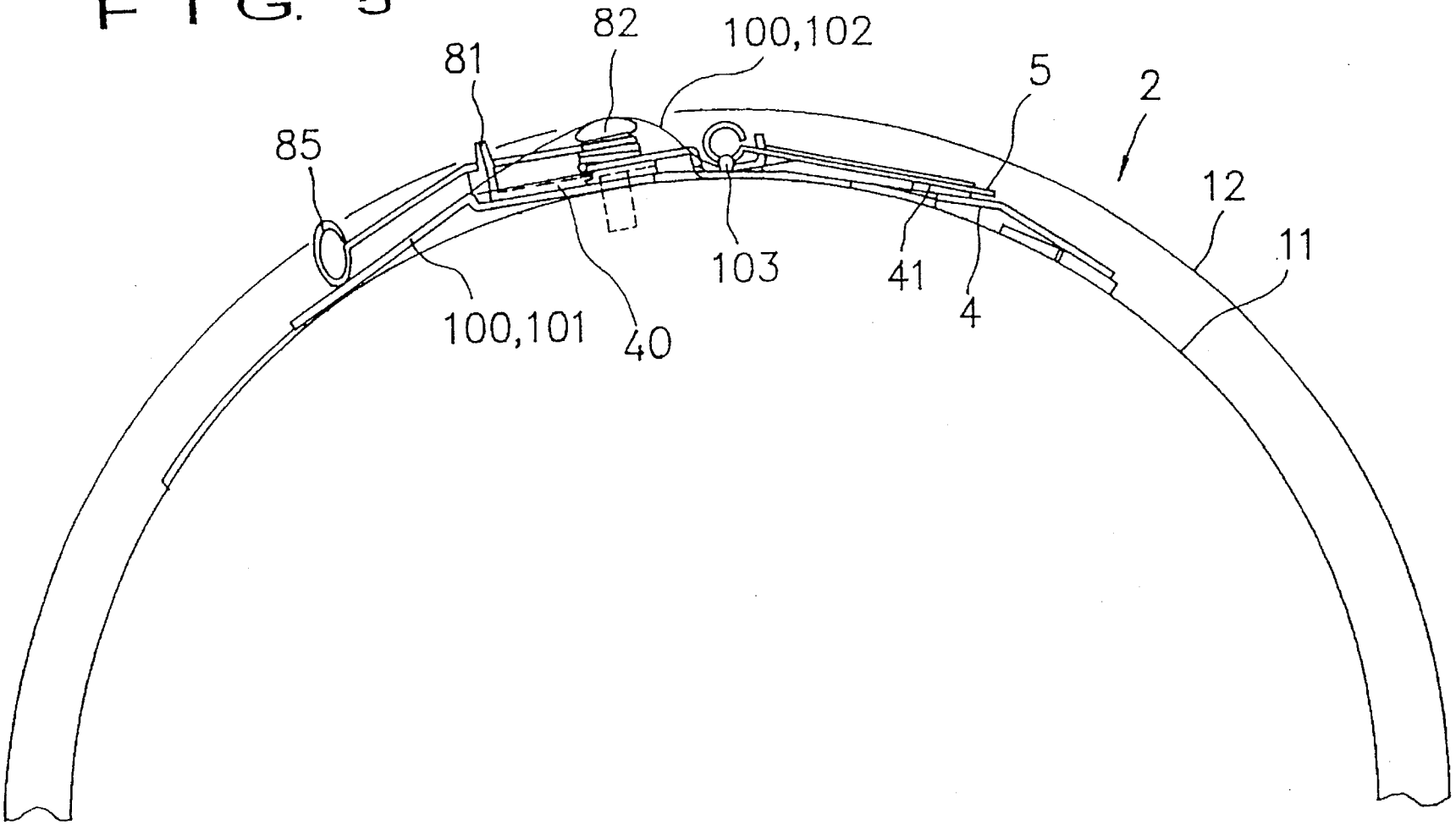
FIG. 5 is a sectional view taken along line 5—5 of FIG. 4.

That is, the clamp plate 5 can rotate between the clamp position shown in FIGS. 2 and 3 in which the clamp plate 5 is magnetically attracted by the magnetic plate 40 to hold the leading edge of the stencil paper S and the unclamp position shown in FIGS. 4 and 5 in which the clamp plate is turned through 180 degrees from the clamp position and magnetically attracted by the other magnetic plate 41.

In both positions off the clamp area of the stencil paper S, in the vicinity of both ends of the clamp plate 5 on the stage section 4, stencil paper holding means 80 and 90 are provided. The stencil paper holding means 80 and 90 are members for retaining both sides near the leading edge of the stencil paper S on the outer peripheral surface of the printing drum 2, that is, on the upper surface of the stage section 4 in the present embodiment, when the clamp plate 5 is released.

First explained is one stencil paper holding means 80 shown in FIG. 6. A driven member 81 which is an approximately L-shaped plate member is rotatably attached by a screw 82 in relation to the stage section 4. To this screw 82 is installed a torsion coil spring 83 as an energizing member. One arm 83*a* of the torsion coil spring 83 is held on the flange 13, while the other arm 83*b* is engaged in a slot section 84*a* formed in the vertical piece 84 of the driven member 81. Therefore, the driven member 81, though pressed towards the center of the printing drum 2 on the center of the screw 82, is engaged with a part of the bearing 15 as shown in FIG. 6, and is blocked from further rotation. The other arm 83*b* of the torsion coil spring 83 has a ring-like end, which serves as a holding member 85 for holding the stencil paper S.

In the state shown in FIG. 6, the clamp plate 5 is open and the holding member 85 formed in a shape of ring is holding, on the upper surface of the stage section 4, the side part of the stencil paper S at a specific distance on the delay side of rotation of the printing drum 2 from the leading edge of the stencil paper S.

When the clamp plate 5 rotates towards the clamping position, the end part of the clamp plate 5 located on the flange 13 side engages with the inclined part 84*b* of the vertical piece 84 of the driven member 81. The driven member 81 pressed by the clamp plate 5 is rotated outward to move away from the side part of the stencil paper S. Consequently the holding member 85 formed in the shape of ring also moves towards the flange 13 side away from the side part of the stencil paper S, thereby releasing the side part of the stencil paper S.

Next, a reason for forming the ring-shaped holding member 85 will be explained. When the holding member 85 moves between the holding position where the side part of the stencil paper S is held by the holding member 85 and the non-holding position apart from the holding position, particularly when the holding member 85 moves from the non-holding position to the holding position, the side part of the stencil paper S must not be caught and turned up by the forward end of the holding member 85. The adoption of the ring-shaped holding member 85 can prevent this trouble. That is, the holding member 85 may be of any other shape than the ring shape so long as it can obviate the above-described disadvantage. Also, any other member such as a spherical resin member may be installed on the forward end of the arms 83*b* and 93*b*.

Next, another stencil paper holding means 90 shown in FIG. 7 will be explained. This stencil paper holding member 90 also has a driven member 91 rotatably supported by fastening by a screw 92 to the stage section 4. To this screw 92 is installed the torsion coil spring 93 as an energizing member. One arm 93*a* of the torsion coil spring 93 is engaged with the bearing 16, while the other arm 93*b* is engaged in the slot 94*a* formed in the vertical piece 94 of the driven member 91. Therefore, an engaging section 94*c* formed on the vertical piece 94 of the driven member 91 is engaged with the side part of the stage section 4 located on the flange 12 side as shown in FIG. 7, thereby being checked from further rotation. The forward end of the other arm 93*b* of the torsion coil spring 93 is formed in a shape of a ring, which portion serves as a holding member 95 for holding the stencil paper S.

In the state shown in FIG. 7, the clamp plate 5 is open and the holding member 95 formed in the shape of a ring holds on the upper surface of the stage section 4 the side part of the stencil paper S at a specific distance apart towards the delay side of rotation of the printing drum 2 from the leading edge of the stencil paper S.

With the rotation of the clamp plate 5 towards the clamping position, the end of the clamp plate 5 located on the flange 12 side is engaged with the inclined part 94*b* provided on the vertical piece 94 of the driven member 91. The driven member 91 pushed by the clamp plate 5 rotates outwards in a direction in which the driven member 91 will move away from the side part of the stencil paper S. Accordingly, the ring-shaped holding member 95 also moves to the flange 12 side away from the side part of the stencil paper S, thus releasing the side part of the stencil paper S.

According to one pair of holding means 80 and 90 explained above, when the clamp plate 5 is in the clamping position and the leading edge of the stencil paper S is clamped between the magnetic plate 40 provided on the A surface of the stage section 4 and the clamp plate 5 as shown in FIG. 2, the stencil paper is not held by the holding member 85 and 95 of the stencil paper holding means 80 and 90.

When the clamp plate 5 is held on the flat surface B of the stage section 4, that is, when the clamp plate 5 is in the unclamp position in which the stencil paper S is released, the holding members 85 and 95 of the stencil paper holding means function to hold both sides near the leading edge of the stencil paper S to the stage section 4 as shown in FIGS. 4, 6 and 7.

On the stage section 4 is provided a raising member 100 which functions with the opening and closing operation of the clamp plate 5. This raising member 100 is a member which forces to raise the vicinity of the leading edge of the stencil paper S from the stage section 4 when the clamp plate 5 is opened, thereby facilitating the following stripping operation to remove the stencil paper S from the printing drum 2. Furthermore, the raising member 100 is an elastic sheet-like member, which can be produced of for example an approximately 0.5 to 0.005 mm thick polyester sheet, carbon fiber sheet, etc.

As shown in FIGS. 4 and 5, the base section 101 of the raising member 100 is secured on the flat surface A of the stage section 4. The base section 101 of the raising member 100 is a belt-like member disposed longitudinally along the axis of the printing drum 2; the length thereof in the lengthwise direction is equal to the width of the stencil paper S. From the edge of the clamp plate 5 side of the base section 101 of the raising member 100, a plurality of slender belt-like raising sections 102 are extended as one unit. Each of the belt-like raising sections 102 is disposed in a position corresponding to a gap between a plurality of magnetic plates. On the stage section 4 between the flat surfaces A and B is provided a shaft 103 parallel with the axis of the printing drum 2. Furthermore, each of the raising sections 102 passes under the shaft 103 and are led to the other magnetic plate 41 side; and the forward end of the raising section 102 is secured to the clamp plate 5.

As shown in FIGS. 2 and 3, when the clamp plate 5 is magnetically attracted by the magnetic plate 40 and the leading edge of the stencil paper S is held between the clamp plate 5 and the magnetic plate 40 and fastened on the stage section 4, the raising section 102 enters a gap between the magnetic plates 40, and is secured between the clamp plate 5 and the stage section 4.

The clamp plate 5, when turned through about 180 degrees from the state shown in FIGS. 2 and 3, is attracted by the other magnetic plate 41 as shown in FIGS. 4 and 5, thereby unclamping the stencil paper S. When the clamp plate 5 rotates towards releasing the stencil paper as described above, the raising section 102 surrounding the shaft 103 is pushed out to the stencil paper S side. The raising section 102 secured to the base section 101 on the stage section 4, rises, around the shaft 103, into a curved form on the flat surface A side of the stage section 4. The stencil paper S released from the clamp plate 5 is forced to separate from the upper surface of the magnetic plate 40 by the operation of the raising section 102 which moves upwards, even if the leading edge of the stencil paper S is held electrostatically or otherwise in close contact with the upper surface of the magnetic plate 40.

Next, the stencil paper discharge operation in the mimeographic printing machine 1 of the present embodiment will be explained. The mimeograph stencil paper S is wrapped around the printing drum 2 with the leading edge thereof fixed by means of the clamp plate 5 when printing is performed. When the stencil paper S is secured by the clamp plate 5, the holding members 85 and 95 of the stencil paper holding means 80 and 90 are released from the stencil paper S, and therefore the printing operation will be performed without any trouble. After printing is finished, the printing drum 2 is positioned in a position shown in FIG. 1.

The clamp solenoid 18 is energized to move the driving gear 19*a* of the clamp driving unit 19 into mesh with the gear 17 mounted on the pivot shaft 16 of the clamp plate 5. The driving gear 19*a* of the clamp driving unit 19 is driven to thereby rotate the gear 17, the clamp plate 5 clamping the stencil paper S turns in a direction in which the clamp plate 5 moves away from the stencil paper S. The clamp plate 5 is attracted by the magnetic plate 41, thus releasing the stencil paper S.

Subsequently, the printing drum 2 rotates clockwise in FIG. 1. The stencil paper discharge craw driving solenoid 53 operates in synchronization with the rotation of the printing drum 2, so that the stencil paper discharge craw 51 is moved towards approaching the printing drum 2, and is set in a position in which the stencil paper S is removed. Then, the leading edge of the stencil paper S thus released is guided by the stencil paper discharge craw 51 to the stencil paper discharge rollers 56. The stencil paper S is peeled from the printing drum 2 by the rotation of the printing drum 2 and the stencil paper discharge rollers 56, and is stored in the discharged stencil paper storing box 57.

Next, operation of the raising member 100 and the stencil paper holding means 80 and 90 when the clamp plate 5 is released will be explained. First, with the unclamping operation of the clamp plate 5, the raising section 102 rises and the leading edge of the stencil paper S secured with the clamp plate 5 is raised off the stage section 4 if stuck on the stage section 4.

Also, in the state the clamp plate 5 is released, the holding members 85 and 95 of the stencil paper holding means 80 and 90 hold both sides near the leading edge of the stencil paper S to the stage section 4 as shown in FIGS. 4, 6 and 7.

Therefore, the stencil paper holding means 80 and 90 hold the stencil paper S in an appropriately raised state even in the case the stencil paper S is curled (upward curl) off the outer peripheral surface of the printing drum 2. Thus, the stencil paper S can be properly guided to the stencil paper discharge rollers 56 without being affected by the speed of rotation of the printing drum 2 at the time of stencil paper discharge.

When the stencil paper S is curled (downward curl) towards the outer peripheral surface of the printing drum 2, the leading edge of the stencil paper S tends to slip down to the opposite direction of rotation of the printing drum when the leading edge of the stencil paper S is raised by the raising section 102. However, since the raising member 100 and the stencil paper holding means 80 and 90 are provided in the present embodiment, the vicinity of the leading edge of the stencil paper S is pressed to the outer peripheral surface of the printing drum 2 by the stencil paper holding means 80 and 90 when raised by the raising section 102, thereby preventing the dislocation of the stencil paper S from the printing drum 2 and accordingly properly forming a gap between the printing drum 2 and the stencil paper S into which the stencil paper discharge craw 51 can be inserted to guide the leading edge of the stencil paper S properly to the stencil paper discharge rollers 56. In this case, the vicinity of the leading edge of the stencil paper S is held by the holding members 85 and 95 of the stencil paper holding means 80 and 90 in such a position between the base end of the raising section 102 and the opening section O that the raising operation of the raising section 102 will not be interfered with.

The mimeographic printing machine of the present invention has a stencil paper holding means for holding the vicinity of the leading edge of the stencil paper on the printing drum side when the clamping means clamping the leading edge of the stencil paper wrapped around the printing drum is released.

According to the present invention, a stencil paper jam resulting from the curling of the leading edge of the stencil paper when the stencil paper is released from the clamping means can be prevented, allowing properly guiding the leading edge of the stencil paper to the stencil paper discharge section.

What is claimed is:

1. A mimeographic printing machine, comprising:

a cylindrical printing drum which has inner and outer peripheral surfaces and an ink-pervious area for passing ink from the inner peripheral surface to the outer peripheral surface, and is driven to rotate on a center axis of itself with a stencil paper wrapped around said outer peripheral surface;

ink supply means provided within said printing drum, for supplying the ink to said inner peripheral surface;

clamping means provided on said outer peripheral surface of said printing drum, for clamping on said printing drum a leading edge of said stencil paper wrapped around said outer peripheral surface; and stencil paper holding means movably mounted on said outer peripheral surface of said printing drum, for holding said stencil paper on said printing drum in the vicinity of the leading edge of said stencil paper when said clamping means has released said stencil paper.

2. A mimeographic printing machine, comprising:

a cylindrical printing drum which has inner and outer peripheral surfaces and an ink-pervious area for passing ink from the inner peripheral surface to the outer peripheral surface, and is driven to rotate on a center axis of itself with a stencil paper wrapped around said outer peripheral surface;

ink supply means provided within said printing drum, for supplying the ink to said inner peripheral surface;

clamping means provided on said outer peripheral surface of said printing drum, for clamping on said printing drum a leading edge of said stencil paper wrapped around said outer peripheral surface; and stencil paper holding means movably mounted on said outer peripheral surface of said printing drum, for holding said stencil paper on said printing drum in the vicinity of the leading edge of said stencil paper when said clamping means has released said stencil paper, and for releasing said stencil paper when said clamping means has clamped said stencil paper.

3. A mimeographic printing machine according to claim 2, wherein said clamping means has a shaft provided on said outer peripheral surface of said printing drum in parallel with the center axis of said printing drum, and a clamp plate rotating relative to said shaft.

4. A mimeographic printing machine according to claim 3, wherein said stencil paper holding means has a driven member which is provided on said outer peripheral surface of said printing drum so as to be movable between inside and outside positions relative to a rotation range of said clamp plate, and moves from the inside position to the outside position when said clamp plate moves to a position of holding the stencil paper and contacts the driven member; an energizing member for urging the driven member to the inside position disposed in the rotation range of said clamp plate; and a holding member provided on said driven member, for holding said stencil paper on said printing drum in the vicinity of the leading edge of said stencil paper when said driven member has been set in the inside position disposed in the rotation range of said clamp plate.

5. A mimeographic printing machine according to claim 4, further comprising: a raising member provided on said outer peripheral surface of said printing drum, which rises outwards from said outer peripheral surface of said printing drum to raise said stencil paper off said outer peripheral surface of said printing drum when said stencil paper is released from said clamping means.

6. A mimeographic printing machine according to claim 5, wherein said clamping means has a stencil paper support surface on said outer peripheral surface of said printing drum for holding the leading edge of said stencil paper between said stencil paper support surface and said clamp plate.

7. A mimeographic printing machine according to claim 6, wherein said raising member is an elastic thin piece secured at one end by said clamp plate and at the other end on said outer peripheral surface of said printing drum, and a portion between said one end and said other end is disposed at least partly above of said stencil paper support surface, and said raising member rises off said stencil paper support surface when said clamp plate moves away from said stencil paper support surface.

* * * * *